US009382810B2

(12) United States Patent
Lacy et al.

(10) Patent No.: US 9,382,810 B2
(45) Date of Patent: Jul. 5, 2016

(54) CLOSED LOOP COOLING SYSTEM FOR A GAS TURBINE

(75) Inventors: Benjamin Paul Lacy, Greer, SC (US); Gregory Allan Crum, Mauldin, SC (US); James William Vehr, Easley, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1000 days.

(21) Appl. No.: 13/560,042

(22) Filed: Jul. 27, 2012

(65) Prior Publication Data

US 2014/0030073 A1 Jan. 30, 2014

(51) Int. Cl.

| | |
|---|---|
| ***F01D 25/08*** | (2006.01) |
| ***F01D 25/12*** | (2006.01) |
| *F01D 9/06* | (2006.01) |

(52) U.S. Cl.

CPC ..... *F01D 25/12* (2013.01); *F01D 9/065* (2013.01); *F05D 2250/14* (2013.01); *F05D 2250/75* (2013.01)

(58) Field of Classification Search

CPC ..... F01D 5/085; F01D 5/087; F01D 9/065; F01D 11/24; F01D 25/12; F01D 25/14; F05D 2250/14; F05D 2250/75; F05D 2260/20; F05D 2260/208

USPC ..... 415/115, 116, 175–179

See application file for complete search history.

(56) References Cited

U.S. PATENT DOCUMENTS

| | | | | |
|---|---|---|---|---|
| 5,540,547 | A * | 7/1996 | Cole | 415/177 |
| 5,685,693 | A * | 11/1997 | Sexton | F01D 11/24 415/173.1 |
| 5,697,208 | A | 12/1997 | Glezer et al. | |
| 6,185,925 | B1 * | 2/2001 | Proctor et al. | 60/806 |
| 7,900,437 | B2 * | 3/2011 | Venkataramani | F01D 9/06 244/134 R |
| 7,914,253 | B2 | 3/2011 | Vedhagiri et al. | |
| 8,015,824 | B2 | 9/2011 | Vedhagiri et al. | |
| 8,047,763 | B2 | 11/2011 | Black | |
| 2003/0065436 | A1 * | 4/2003 | Hyakutake et al. | 701/100 |
| 2007/0140838 | A1 * | 6/2007 | Estridge et al. | 415/178 |
| 2010/0124483 | A1 * | 5/2010 | Weaver et al. | 415/115 |
| 2011/0271689 | A1 | 11/2011 | Lacy et al. | |
| 2012/0076645 | A1 * | 3/2012 | Tibbott | 415/180 |
| 2012/0087784 | A1 | 4/2012 | Widener | |

* cited by examiner

*Primary Examiner* — Eric Keasel
*Assistant Examiner* — Alexander White
(74) *Attorney, Agent, or Firm* — Dority & Manning, PA

(57) ABSTRACT

A system for removing heat from a gas turbine generally includes a plurality of stationary nozzles arranged in an annular array within the gas turbine. Each of the plurality of stationary nozzles may include a radially outer platform and a radially extending cooling passage. The radially extending cooling passage may have an inlet that extends generally axially and circumferentially across a portion of the radially outer platform. A closed loop cooling coil may extend continuously circumferentially around the radially outer platform of two or more of the plurality of stationary nozzles. The closed loop cooling coil may be disposed circumferentially across and outside of the inlet of the radially extending cooling passage of each of the two or more stationary nozzles, and a cooling medium may flow through the cooling coil and out of the gas turbine so as to remove heat from the gas turbine.

10 Claims, 3 Drawing Sheets

CLOSED LOOP COOLING SYSTEM FOR A GAS TURBINE

FIELD OF THE INVENTION

The present invention generally involves a closed loop cooling system for a gas turbine.

BACKGROUND OF THE INVENTION

Gas turbines are widely used in commercial operations for power generation. A typical gas turbine includes a compressor, one or more combustors downstream from the compressor, and a turbine downstream from the one or more combustors. A working fluid such as air flows through an inlet of the compressor wherein the compressor imparts kinetic energy to the working fluid to bring it to a highly energized state. The compressed working fluid exits the compressor and flows to the combustors. The combustors mix fuel with a first portion of the compressed working fluid, and the mixture of fuel and working fluid ignites to generate combustion gases having a high temperature, pressure, and velocity. The combustion gases flow to the turbine where they expand to produce work. A second portion of the compressed working fluid may be used to cool various components within the gas turbine.

It is widely known that the thermodynamic efficiency of a gas turbine increases as the operating temperature, namely the combustion gas temperature, increases. Higher temperature combustion gases contain more energy and produce more work as the combustion gases expand in the turbine. However, higher temperature combustion gases may produce excessive temperatures in the turbine that can approach or exceed the melting temperature of various turbine components.

A variety of techniques exist to allow the combustors to operate at higher temperatures. For example, air may be extracted from the compressor, bypassed around the combustors, and injected directly into the stream of combustion gases in the turbine to provide conductive and/or convective cooling to the turbine stages. However, the air extracted from the compressor has already been compressed, and thus heated, by some amount, thereby reducing the heat removal capability of the extracted air. In addition, since the extracted air bypasses the combustors, extracting air from the compressor reduces the volume of combustion gases and overall efficiency and output of the gas turbine.

Another method to cool turbine components may include circulating a portion of the compressed working fluid through various flow paths within the gas turbine. For example, the turbine typically includes stationary nozzles (stators) and rotating blades (buckets). The stators and/or buckets may include internal passages through which cooling air may flow. As the cooling air flows through the internal passages, the cooling air directly contacts the walls of the internal passages to remove heat from the stators and/or buckets through conductive or convective cooling. However, the elevated temperature of the compressed working fluid available for cooling generally limits the rate of heat transfer between the compressed working fluid and the walls of the internal passages. Other methods for cooling the gas turbine may include directing a cooling fluid, such as steam into various portions of the gas turbine. However, these methods may create problems with oxidization within the gas turbine and may reduce overall plant efficiency. Therefore, a closed loop cooling system that can remove heat from the compressed working fluid flowing though the gas turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a system for removing heat from a gas turbine. The system may generally include a plurality of stationary nozzles arranged in an annular array within the gas turbine. Each of the plurality of stationary nozzles may generally have a radially outer platform and a radially extending cooling passage. The radially extending cooling passage may have an inlet that extends axially and circumferentially across a portion of the radially outer platform. A closed loop cooling coil may extend continuously circumferentially around the radially outer platform of two or more of the plurality of stationary nozzles. The cooling coil may be disposed circumferentially across and outside of the inlet of the radially extending cooling passage of each of the two or more stationary nozzles. The system may also include a cooling medium that flows through the cooling coil and out of the gas turbine so as to remove heat from the gas turbine.

Another embodiment of the present invention is a system for cooling a turbine. In this embodiment the system may generally include a compressor generally upstream from the turbine. A rotor disk may be coupled to a rotor shaft that extends generally axially through the turbine. The rotor disk may generally define a cooling passage that extends generally radially through the rotor disk. A compressed working fluid may flow from the compressor into the rotor disk cooling passage. A closed loop cooling coil may be enclosed within the gas turbine between the compressor and the rotor disk cooling passage. A cooling medium may flow through the cooling coil and out of the gas turbine so as to remove heat from the compressed working fluid flowing into the rotor disk cooling passage.

The present invention may also include a system for cooling a gas turbine. The system may generally include an outer casing and a plurality of stationary nozzles arranged in an annular array about an axial centerline of the gas turbine. Each of the plurality of stationary nozzles may have a radially outer platform and may define a radially extending cooling passage. The radially extending cooling passage may have an inlet that extends axially and circumferentially across a portion of the radially outer platform. The outer casing may at least partially surround the plurality of stationary nozzles. A closed loop cooling coil may extend continuously circumferentially around the annular array of the stationary nozzles between the radially outer platform and the outer casing. The cooling coil may extend across and outside of the inlet of the radially extending cooling passage of each of the plurality of stationary nozzles. A cooling medium may flow through the cooling coil and out of the gas turbine so as to remove heat from the gas turbine.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
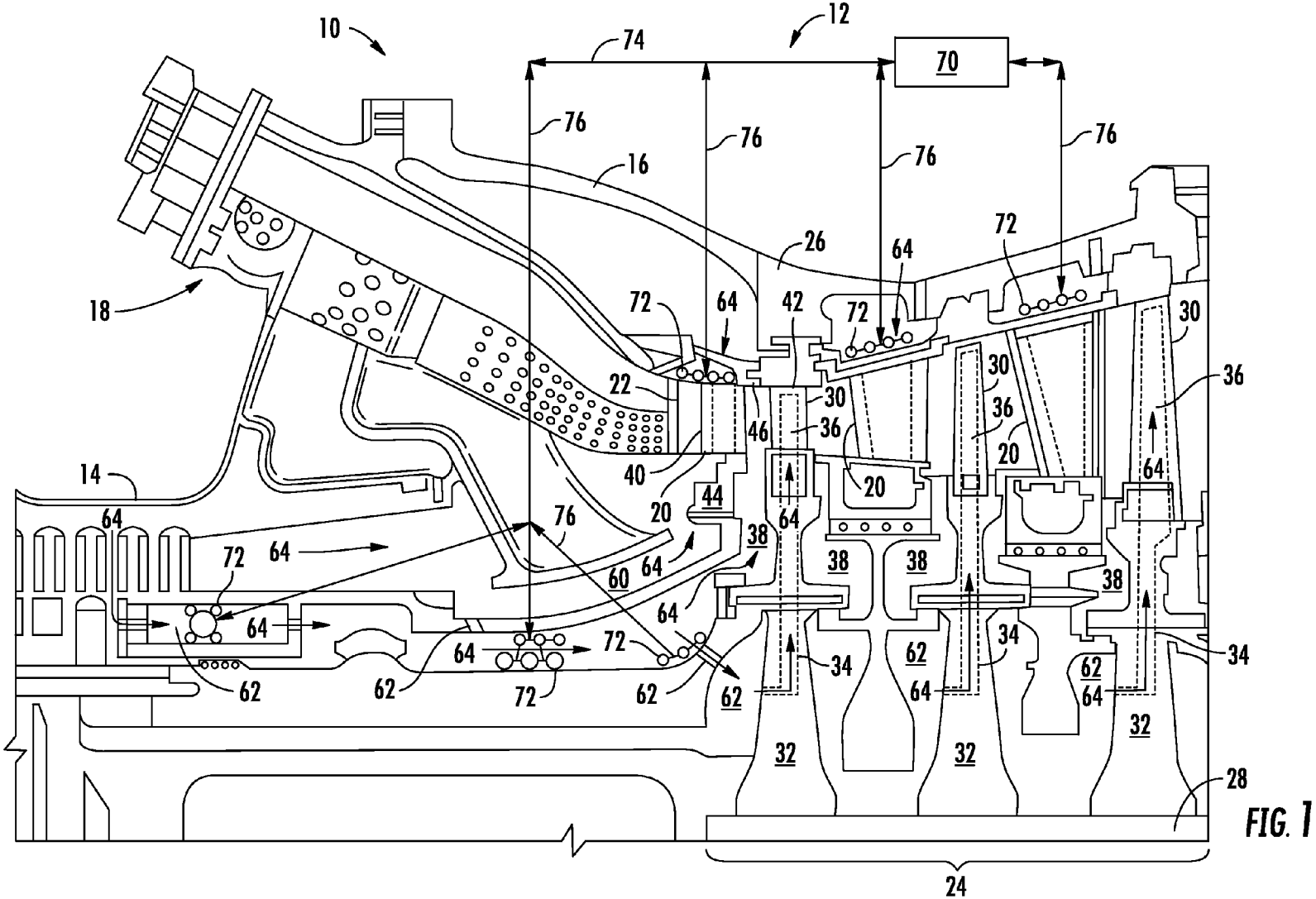
FIG. 1 illustrates a simplified cross section side view of a portion of an exemplary gas turbine having a closed loop cooling system according to at least one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a closed loop cooling system for removing heat from a gas turbine. The closed loop cooling system generally includes one or more cooling coils enclosed within the gas turbine. In particular embodiments, the gas turbine may include a plurality of stationary nozzles disposed within the gas turbine and arranged in an annular array about an axial centerline of the gas turbine. Each of the plurality of stationary nozzles may generally have an inner platform, a radially outer platform, an airfoil that extends radially between the inner and outer platforms and a radially extending cooling passage that extends at least partially through the radially outer platform and the airfoil of each of the stationary nozzles. The radially extending cooling passage may have an inlet that extends axially and circumferentially across at least a portion of the radially outer platform and that provides fluid communication into the radially extending passage. The cooling coil may extend generally circumferentially around the radially outer platform across and outside of the inlet of the radially extending cooling passage of at least some of the plurality of stationary nozzles.

In operation, a compressed working fluid may flow from a compressor disposed upstream from the plurality of stationary nozzles, across the one or more cooling coils and into the inlet of the radially extending cooling passages of the stationary nozzles. A cooling medium may flow from an external cooling medium source, into the gas turbine, through the one or more cooling coils and out of the gas turbine so as to remove heat from the gas turbine. In particular, so as to remove heat from the compressed working fluid flowing into the radially extending cooling passages of the stationary nozzles, thereby enhancing the heat transfer between the compressed working fluid and the plurality of stationary nozzles. As a result, less of the compressed working fluid may be required to cool the part, thereby increasing efficiency, or the reduced coolant temperature will reduce thermal stresses on the part increasing part life/reliability. Although exemplary embodiments of the present invention will be described generally in the context of a cooling system incorporated into an industrial gas turbine for purposes of illustration, one of ordinary skill in the art will readily appreciate that embodiments of the present invention may be applied to any turbo machine and are not limited to an industrial gas turbine unless specifically recited in the claims.

FIG. 1 illustrates a simplified cross section side view of a portion of an exemplary gas turbine 10 having a closed loop cooling system 12 according to at least one embodiment of the present disclosure. As shown in FIG. 1, the gas turbine 10 generally includes a compressor 14, a compressor discharge casing 16 that at least partially surrounds an aft end of the compressor 14, at least one combustor 18 at least partially encased within the compressor discharge casing 16, a plurality of stationary nozzles 20 arranged in annular array about an axial centerline of the gas turbine 10 and adjacent to a downstream end 22 of the at least one combustor 18, and a turbine section 24 downstream from the at least one combustor 18. The turbine section 24 generally includes an outer casing 26, a rotor shaft 28 that extends generally axially through the turbine section 24, and a plurality of turbine blades 30 coupled to a rotor disk 32 generally downstream from the plurality of stationary nozzles 20. The rotor disk 32 generally circumferentially surrounds and extends radially outward from the rotor shaft 28. Each annular array of the plurality of stationary nozzles 20 generally defines a stage of the stationary nozzles 20. Each rotor disk 32 and accompanying turbine blades 30 generally defines a stage of the turbine blades 30. As shown, the turbine section 24 may further include additional stages of the stationary nozzles 20 alternating with additional stages of the turbine blades 30. The additional stages of the turbine blades 30 may be spaced axially apart through the turbine section 24 along the rotor shaft 28.

In particular embodiments, as shown in FIG. 1, each or some of the rotor disks 32 may include an internal cooling passage 34 that extends generally radially and/or generally axially through and/or within the rotor disks 32. In addition or in the alternative, each of the plurality of turbine blades 30 may include a radially and/or axially extending internal cooling passage 36. In particular gas turbine designs, the rotor disk 32 internal cooling passage 34 may be in fluid communication with the turbine blade 30 internal cooling passage 36.

A volume 38, herein referred to as "the wheel space 38", may be at least partially defined between at least one of an aft-end of the compressor 14, the compressor discharge casing 16 or a mounting portion of a first stage 40 of the stationary nozzles 20, and the rotor disk 32 of a first stage 42 of the turbine blades 30. In addition or in the alternative, the wheel space 38 may be defined between each adjacent rotor disk 32 of the additional stages of the turbine blades 30 disposed axially through the turbine section 24 along the rotor shaft 28.

Figure 2:
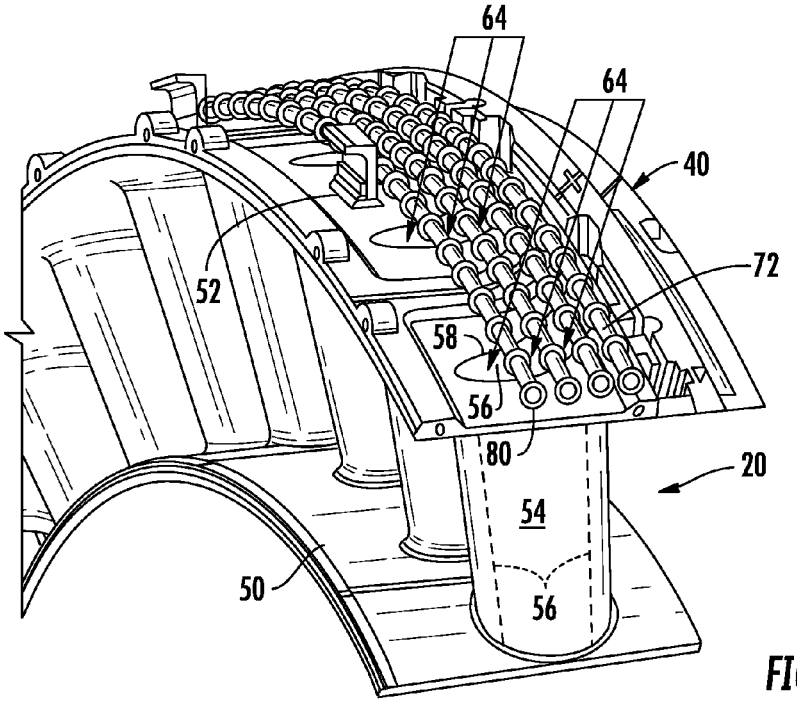
FIG. 2 illustrates an enlarged perspective view of a portion of the closed loop cooling system and a portion of the gas turbine according to at least one embodiment of the present disclosure, as shown in FIG. 1.
Figure 3:
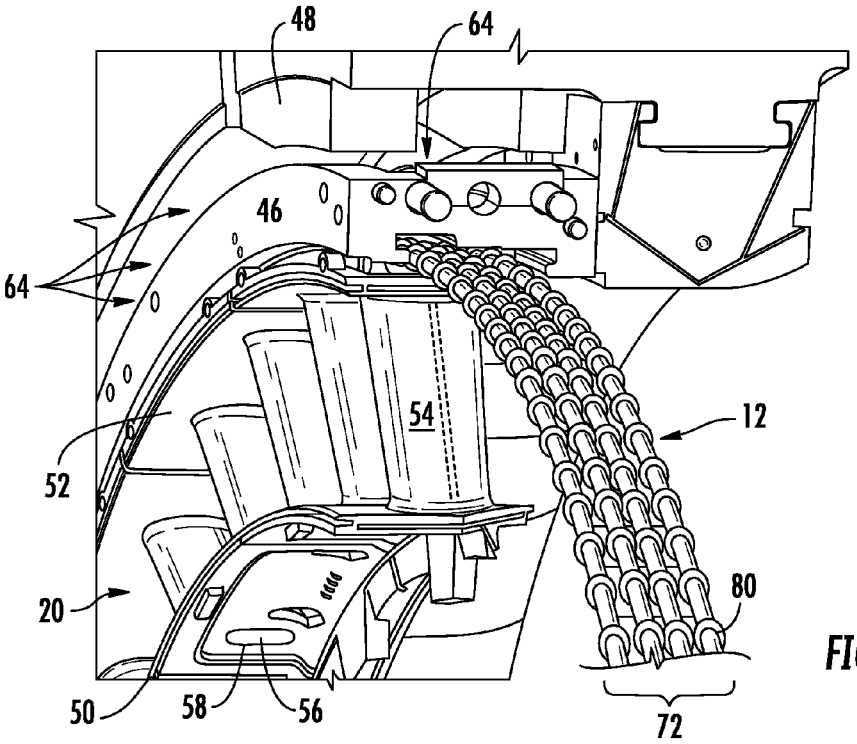
FIG. 3 illustrates an enlarged perspective view of a portion of the closed loop cooling system and a portion of the gas turbine according to at least one embodiment of the present disclosure, as shown in FIG. 1.

FIGS. 2 and 3 illustrate enlarged perspective views of a portion of the closed loop cooling system 12 and a partial view of a stage of the stationary nozzles 20 as shown in FIG. 1. As shown in FIG. 1, each of the plurality of stationary nozzles 20 may be coupled to at least one of an inner retaining ring 44, an outer retaining ring 46 as shown in FIGS. 1 and 3, and/or to an outer casing 48 as shown in FIG. 3. The outer retaining ring 46 and/or the outer casing 48 may at least partially circumferentially surround the plurality of stationary nozzles 20.

As shown in FIGS. 2 and 3, each of the plurality of stationary nozzles 20 may generally include an inner platform 50, an outer platform 52 radially separated from the inner platform 50, and an airfoil 54 that extends generally radially between the inner and the outer platforms, 50 & 52 respectfully. As shown in FIG. 2, a cooling passage 56 may extend generally radially through the outer platform 52 and/or the airfoil 54 of each or some of the stationary nozzles 20. In addition or in the alternative, as shown in FIG. 3, the cooling passage 56 may extend through the inner platform 50 of each or some of the plurality of stationary nozzles 20. In particular embodiments, as shown in FIG. 2, an inlet 58 to the cooling passage 56 may extend radially through the outer platform 52 and may extend generally axially and circumferentially across at least a portion of the outer platform 52 of each or some of the plurality of stationary nozzles 20. In addition or in the alternative, as shown in FIG. 3, the inlet 58 to the cooling passage 56 may extend radially through the inner platform 50 and may extend generally axially and circumferentially across at least a portion of the inner platform 50 of each or some of the stationary nozzles 20. In either configuration, the inlet 58 may generally provide fluid communication into the cooling passage 56 through at least one of the outer platform 52 or the inner platform 50.

As shown in FIG. 1, one or more flow paths may be defined within the gas turbine so as to provide fluid communication between the compressor 14 and various sections of the gas turbine 10. A primary flow path 60 may provide fluid communication between the compressor 14 and the compressor discharge casing 16 and/or the combustor 18. One or more secondary flow paths 62 may provide fluid communication between the compressor 14 and various other portions of the gas turbine 10. For example, the one or more secondary flow paths 62 may provide fluid communication between the compressor 14 and at least one of the wheel space 38, the internal cooling passages 34 of the one or more rotor disks 32, or the internal cooling passages 36 of the one or more of the plurality of turbine blades 30. By way of further example, but not limiting of, the one or more secondary flow paths 62 may provide fluid communication between the compressor 14 and a packing seal (not shown), a turbine exhaust housing (not shown) and/or a bearing housing (not shown) within the gas turbine 10.

In operation, as shown in FIG. 1, a compressed working fluid 64 such as air may flow from the compressor 14 through the primary and secondary flow paths, 60 & 62. At least a portion of the compressed working fluid 64 flowing through the primary flow path 60 may flow to the combustor 18 and may be mixed with fuel for combustion. Another portion of the compressed working fluid 64 may flow into the inlet 58 and through the radially extending cooling passage 56 of each or some of the stationary nozzles 20, thereby providing cooling to each or some of the stationary nozzles 20. In particular, providing cooling to the airfoil 54 of each or some of the stationary nozzles 20. In addition or in the alternative, at least a portion of the compressed working fluid 64 directed through the one or more secondary flow paths 62 may be directed to the wheel space 38 and/or to the internal cooling passages 34 of one or more of the one or more rotor disks 32, and/or to the internal cooling passage 36 extending through at least some of the plurality of turbine blades 30.

As shown in FIG. 1, the closed loop cooling system 12, herein referred to as "the cooling system 12" may generally include an external cooling medium source 70, a closed loop cooling coil 72 herein referred to as "the cooling coil 72" enclosed within the gas turbine 10 and in fluid communication with the cooling medium source 70, and a cooling medium 74 that flows from the cooling medium source 70, through the cooling coil 72 and out of the gas turbine 10, thereby removing heat from the gas turbine 10.

The cooling medium 74 may comprise of any cooling medium known in the art. For example, the cooling medium may include water, steam and/or a thermal fluid such as a refrigerant or a commercially available heat transfer fluid such as Syltherm 800 or other similar products. The cooling medium source 70 may comprise of any device, system or source of a cooling medium known in the art. In particular embodiments, the cooling medium source 70 may include a heat recovery steam generator herein referred to as "the HRSG". The HRSG may typically be found in a combined cycle power plant. The HRSG generally receives heat energy from the gas turbine 10 positioned upstream from the HRSG. The HRSG may use the heat energy to produce steam to power a steam turbine to further improve the efficiency and power generating capacity of the power plant. In particular embodiments, water and/or steam may be extracted from the HRSG and utilized as the cooling medium 74 for the cooling system 12. In addition, water or steam may flow from the cooling coil 72 back to the HRSG after cycling through the gas turbine 10. In this manner, at least a portion of the heat carried away from the gas turbine 10 by the cooling system 12 may be captured and utilized to improve the efficiency of the HRSG. In addition or in the alternative, the cooling medium source 70 may include a refrigeration system. In addition or in the alternative, the cooling medium source 70 may include an external water source.

As shown in FIG. 1, the cooling system 12 may include one or more flow fluid couplings 76 fluidly connected between the cooling medium source 70 and the cooling coil 72. Some of the one or more fluid couplings 76 may extend through the compressor discharge casing 16, the outer casing 26 and/or any other portion of the gas turbine 10 so as to provide fluid communication between the cooling medium source 70 and the cooling coil 72. Some of the one or more fluid couplings 76 may be configured to allow fluid such as the cooling medium 74 to flow in one or more directions. In particular embodiments, the cooling medium 74 may flow from the cooling medium source 70, through one or more fluid couplings 76, into the gas turbine 10, through the cooling coil 72 and back to the cooling medium source 70, thereby completing the cooling loop. In addition or in the alternative, the cooling medium may flow from the cooling coil 72, out of the gas turbine 10 and to some other device, process or depository configured to receive the cooling medium 74.

Figure 4:
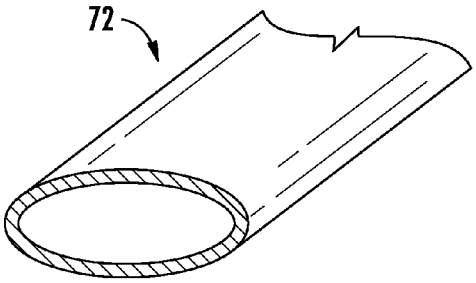
FIG. 4 illustrates a cross section perspective view of a cooling coil of the closed loop cooling system as shown in FIG. 1, according to at least one embodiment of the present disclosure.
Figure 5:
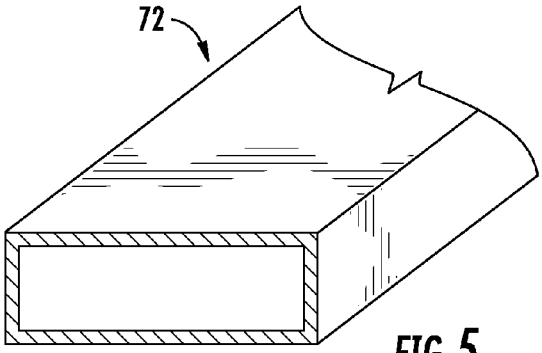
FIG. 5 illustrates a cross section perspective view of a cooling coil of the closed loop cooling system as shown in FIG. 1, according to at least one embodiment of the present disclosure.
Figure 6:
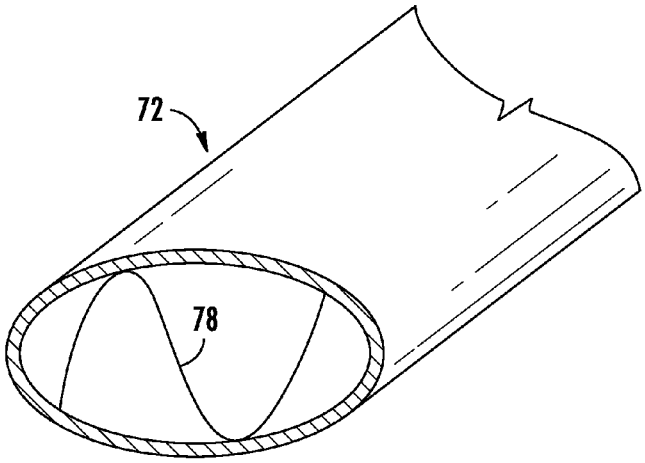
FIG. 6 illustrates a cross section perspective view of a cooling coil of the closed loop cooling system as shown in FIG. 1, according to at least one embodiment of the present disclosure.

FIGS. 4, 5 and 6 provide cross sectional perspective views of the cooling coil 72 according to various embodiments of the present disclosure. As shown, the cooling coil 72 may be any shape and/or size that may allow the cooling medium 74 to circulate therethrough. In particular embodiments, as shown in FIGS. 2 and 3, the cooling coil 72 may be generally cylindrical or tube shaped. In addition or in the alternative, as shown in FIGS. 4 and 5, the cooling coil 72 may be generally non-round. For example, as shown in FIG. 4, the cooling coil 72 may be generally oval and/or at least partially flattened. In the alternative, as shown in FIG. 5, the cooling coil 72 may be generally rectangular. In addition or in the alternative, as shown in FIG. 6, the cooling coil 72 may include various internal heat transfer features 78 that may extend within and/or at least partially through the cooling coil 72, thereby further enhancing the heat transfer performance of the cooling coil 72. In addition or in the alternative, as shown in FIGS. 2 and 3, the cooling coil 72 may include one or more external heat transfer enhancement features 80 such as a radial fin and/or a raised surface feature so as to increase the surface area of the cooling coils 72, thereby enhancing the heat transfer performance thereof.

Figure 7:
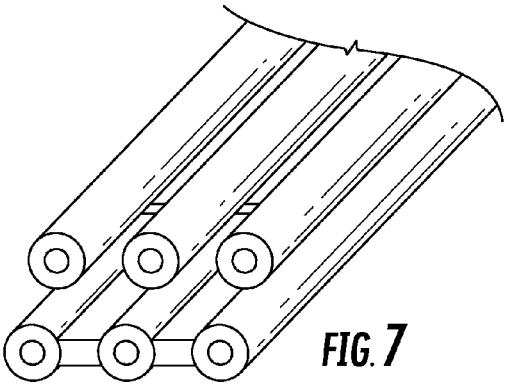
FIG. 7 illustrates a perspective view of a cooling coil of the closed loop cooling system as shown in 1, according to at least one embodiment of the present disclosure.
Figure 8:
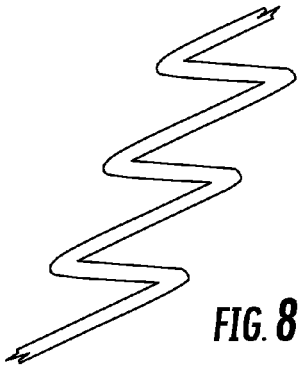
FIG. 8 illustrates a perspective view of a cooling coil of the closed loop cooling system as shown in FIG. 1, according to at least one embodiment of the present disclosure.

As shown in FIG. 2, the cooling coil 72 may be a single continuous cooling coil 72. The cooling coil 72 may extend one or more times around one or more components within the gas turbine 10. In alternate embodiments, the cooling coil 72 may double back and/or may extend through various parts of the gas turbine 10 in a generally serpentine pattern, as shown in FIG. 8. In various embodiments, as shown in FIGS. 1, 3 and 7, the cooling coil 72 may comprise of a plurality of cooling coils 72. Each or some of the plurality of cooling coils 72 may be fluidly connected. The plurality of cooling coils 72 may be arranged in a generally parallel pattern. In particular embodiments, as shown in FIGS. 1, 2, 3 and 7, the plurality of cooling coils 72 may be arranged in various "X" by "Y" patterns where "X" represents the number of cooling coils 72 in an axial direction and "Y" represents the number of cooling coils 72 in a radial direction relative to the axial centerline of the gas turbine 10. For example, but not limiting of, FIG. 3 illustrates a 4 by 1 pattern, and FIG. 7 represents a 3 by 2 pattern.

It should be obvious to one of ordinary skill in the art that, although not illustrated, the plurality of cooling coils 72 may be arranged in any pattern so as to accommodate space restrictions within the gas turbine 10 and/or to optimize the heat removal from the gas turbine 10. For example but not limiting of, the plurality of cooling coils 10 may be arranged in a triangular pattern, an oval pattern, and/or a round pattern. In particular embodiments, as shown in FIGS. 2 and 3, the plurality of cooling coils 72 may extend within the gas turbine 10 in a generally straight and continuous manner. In addition or in the alternative, the plurality of cooling coils 72 may be disposed in at least one of a serpentine pattern as shown in FIG. 8, an overlapping pattern (not shown) or a double back pattern (not shown) so as to best optimize the space available within a particular internal volume of the gas turbine 10 and/or to provide an optimized cooling effect within the gas turbine 10. Other heat exchanger configurations in addition to a coil could also be utilized.

In particular embodiments, as shown in FIGS. 1, 2 and 3 the cooling coil 72 may extend continuously circumferentially around the radially outer platform 54 of at least two or more of the plurality of stationary nozzles 20. In particular embodiments, as shown in FIGS. 1 and 2, the cooling coil 72 may at least partially surround the first stage 42 of stationary nozzles 20. In the alternative, the cooling coil 72 may at least partially surround any stage of the plurality of stationary nozzles 20. As shown in FIG. 2, the cooling coil 72 may extend circumferentially across and outside of the inlet 58 of the radially extending cooling passage 56 of the stationary nozzles 20. In particular embodiments, the cooling coil 72 may be disposed directly over the inlet 58 of the cooling passages 56 of two or more of the plurality of stationary nozzles 20. In addition or in the alternative, the cooling coil 72 may be disposed generally upstream from the cooling passage 56 of each or some of the stationary nozzles 20.

In particular embodiments, as shown in FIGS. 2 and 3, the cooling coil 72 may extend one or multiple times around two or more of the plurality of the stationary nozzles 20. In addition or in the alternative, the cooling coil 72 may extend across the outer platform 52 of at least some of the plurality of the stationary nozzles 20 in a generally serpentine pattern. In this manner, the compressed working fluid 64 may flow across the cooling coil 72 before flowing into the cooling passage 56, thereby removing heat from the compressed working fluid 64. As a result, the compressed working fluid 64 may more effectively cool the stationary nozzles 20, such that less of the compressed working fluid may be required to cool the part, thereby increasing efficiency, or the reduced coolant temperature will reduce thermal stresses on the part increasing part life/reliability. In alternate embodiments, the cooling coil 72 may be disposed substantially between the plurality of stationary nozzles 20 and at least one of the casing 50, the compressor discharge casing 16, the inner retaining ring 46 or the outer retaining ring 48. In particular embodiments, the casing 50, the compressor discharge casing 16, the inner retaining ring 46 or the outer retaining ring 48 may be considered as an outer casing that at least partially surrounds the cooling coil 72. The cooling coil 72 may be coupled to each or some of the plurality of stationary nozzles 20. In addition or in the alternative, the cooling coil 72 may be coupled to at least one of the casing 50, the compressor discharge casing 16, the inner retaining ring 46 or the outer retaining ring 48.

In further embodiments, as shown in FIG. 1, the cooling coil 72 may be disposed within at least one of the one or more secondary flow paths 62. In this manner, the compressed working fluid 64 flowing through the one or more secondary flow paths 62 may be cooled as it flows across the cooling coil 72, thereby enhancing the cooling effect of the compressed working fluid 64 flowing downstream from the cooling coil 72. For example, in particular embodiments, the compressed working fluid 64 may flow from the compressor 14 through at least one of the secondary flow paths 62, across the cooling coil 72 and into at least one of the one or more wheel spaces 38, thereby effectively cooling the rotor disk 32, a portion of the plurality of turbine blades 30 and/or a portion of the plurality of the stationary nozzles 20. In one embodiment, the cooling coil may be placed at the inner barrel to cool the compressed working fluid upstream of the compressor aft shaft to distance piece joint to improved cooling to this joint as well as to the other parts downstream of this joint listed above. As a result less of the compressed working fluid may be required to cool these parts, thereby increasing efficiency, or the reduced coolant temperature will reduce thermal stresses on the part increasing part life/reliability. In addition or in the alternative, as shown in FIG. 1, the compressed working fluid 64 may flow from the compressor 14 through at least one of the secondary flow paths 62, across the cooling coil 72 and into the cooling passages 34 of at least one of the one or more rotor disks 32, thereby more effectively cooling the rotor disk 32. In addition, the compressed working fluid 64 may also flow from the rotor disk 32 and into at least some of the plurality of turbine blades 30, thereby cooling the turbine blades 30 and enhancing the overall mechanical performance of the turbine section 24 of the gas turbine. In addition to the locations described here, any other location in the flow path into which a cooling coil or other heat exchanger can be inserted, could be used as a means to cool the compressed working fluid prior to that working fluids use in cooling any gas turbine components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for cooling a gas turbine, comprising:

a. a compressor generally upstream from the gas turbine;

b. a plurality of rotor disks axially spaced along and coupled to a rotor shaft that extends axially through the turbine, at least one of the rotor disks defining a cooling passage that extends generally radially through the respective rotor disk, wherein two adjacent rotor disks of the plurality of rotor disks defines at least one wheel space therebetween;

c. a compressed working fluid that flows from the compressor into the rotor disk cooling passage and into the at least one wheel space;

d. a closed loop cooling coil enclosed within the gas turbine between the compressor and the rotor disk cooling passage and the at least one wheel space; and e. a cooling medium source in fluid communication with the cooling coil, wherein the cooling medium source provides a cooling medium to the cooling coil, wherein the cooling medium flows through the cooling coil and out of the gas turbine to remove heat from the compressed working fluid flowing into the rotor disk cooling passage and into the at least one wheel space.

2. The system as in claim 1, wherein the cooling coil comprises a single continuous cooling coil.

3. The system as in claim 1, where the cooling coil comprises multiple cooling coils generally arranged in an "X" by "Y" pattern.

4. The system as in claim 1, wherein the cooling medium comprises at least one of water, steam, a refrigerant and a heat transfer fluid.

5. The system as in claim 1, wherein the cooling coil is non-round.

6. A system for cooling a gas turbine, comprising:

a. an outer casing;

b. a plurality of stationary nozzles arranged in an annular array about an axial centerline of the gas turbine, each of the plurality of stationary nozzles having a radially outer platform and defining a radially extending cooling passage, the radially extending cooling passage having an inlet that extends axially and circumferentially across a portion of the radially outer platform, the outer casing at least partially surrounds the plurality of stationary nozzles;

c. a plurality of rotor disks axially spaced along and coupled to a rotor shaft that extends axially through the gas turbine, wherein two adjacent rotor disks of the plurality of rotor disks defines at least one wheel space therebetween;

d. a first closed loop cooling coil enclosed within the gas turbine between a compressor and the at least one wheel space; and e. a second closed loop cooling coil that extends continuously circumferentially around the annular array of the plurality of stationary nozzles between the radially outer platform and the outer casing, wherein the second cooling coil extends across and outside of the inlet of the radially extending cooling passage of each of the plurality of stationary nozzles; and f. a cooling medium source in fluid communication with the first cooling coil and the second cooling coil, wherein the cooling medium source provides a cooling medium to the first cooling coil and to the second cooling coil, wherein a first portion of the cooling medium flows through the first cooling coil and a second portion of the cooling medium flows through the second cooling coil and out of the gas turbine to remove heat from the gas turbine, wherein the first portion of the cooling medium removes heat from a compressed working fluid flowing into the at least one wheel space.

7. The system as in claim 6, wherein at least one of the first cooling coil and the second cooling coil comprises a single continuous cooling coil.

8. The system as in claim 6, where at least one of the first cooling coil and the second cooling coil comprises multiple cooling coils generally arranged in an "X" by "Y" pattern.

9. The system as in claim 6, wherein the first cooling coil forms a serpentine pattern across the radially outer platform.

10. The system as in claim 6, wherein the cooling medium is at least one of water, steam, a refrigerant and a heat transfer fluid.

* * * * *